US006964348B2

(12) United States Patent
Breimon et al.

(10) Patent No.: US 6,964,348 B2
(45) Date of Patent: Nov. 15, 2005

(54) PLASTIC PAINT CAN

(75) Inventors: Mark S. Breimon, Sussex, WI (US); Dean H. Van Haren, Jackson, WI (US); Newton K. Campbell, Troy, AL (US)

(73) Assignee: KW Plastics, Troy, AL (US)

( * ) Notice: Subject to any disclaimer, the term of this patent is extended or adjusted under 35 U.S.C. 154(b) by 35 days.

(21) Appl. No.: 10/278,318

(22) Filed: Oct. 23, 2002

(65) Prior Publication Data

US 2003/0168465 A1 Sep. 11, 2003

Related U.S. Application Data

(63) Continuation-in-part of application No. 10/174,890, filed on Jun. 19, 2002, now abandoned.

(60) Provisional application No. 60/362,462, filed on Mar. 7, 2002.

(51) Int. Cl.[7] ..... B65D 21/036; B65D 41/18; B65D 43/06

(52) U.S. Cl. ..... 220/783; 206/508; 206/509; 220/254.7

(58) Field of Search ..... 220/783, 701, 220/700, 284, 254.7; 206/508, 509

(56) References Cited

U.S. PATENT DOCUMENTS

| | | | | |
|---|---|---|---|---|
| 2,828,789 A | | 4/1958 | Groendyk et al. | 220/783 |
| 2,855,108 A | | 10/1958 | Donoghue | 220/42 |
| 3,223,278 A | | 12/1965 | Allen | 220/60 |
| 4,105,121 A | | 8/1978 | Mascetti | 206/592 |
| 4,180,179 A | | 12/1979 | Hoenig et al. | 220/307 |
| 4,209,107 A | | 6/1980 | Crisci | 220/306 |
| 4,296,871 A | | 10/1981 | Andersson | 220/306 |
| 4,312,459 A | | 1/1982 | Leach | 220/256 |
| 4,356,930 A | | 11/1982 | Roper | 220/306 |
| 4,397,404 A | | 8/1983 | Blanchette | 220/306 |
| 4,524,882 A | | 6/1985 | Buc | 220/306 |
| 4,530,442 A | * | 7/1985 | Vogel et al. | 220/798 |
| 4,619,373 A | | 10/1986 | Galer | 220/354 |
| 4,667,543 A | | 5/1987 | Tsugaki et al. | 76/108 |
| 4,728,003 A | | 3/1988 | Davey | 220/319 |
| 4,887,735 A | | 12/1989 | Dudzik | 220/307 |
| 4,928,839 A | * | 5/1990 | Kruelskie | 206/508 |
| 5,097,977 A | | 3/1992 | Straub | 220/307 |
| 6,250,494 B1 | | 6/2001 | Diamond | 220/783 |
| 6,491,185 B1 | * | 12/2002 | Azzarello et al. | 220/783 |
| 6,588,618 B1 | * | 7/2003 | Davis | 220/254.7 |

FOREIGN PATENT DOCUMENTS

| | | |
|---|---|---|
| GB | 2 261 655 | 5/1993 |
| WO | WO 01/36285 | 5/2001 |

* cited by examiner

*Primary Examiner*—Nathan J. Newhouse
*Assistant Examiner*—Niki M. Eloshway
(74) *Attorney, Agent, or Firm*—Andrus, Sceales, Starke & Sawall, LLP

(57) ABSTRACT

A molded resilient plastic container, such as a paint can, that includes a rim assembly to facilitate the receipt and removal of a plastic lid. The rim assembly is adhesively attached to the main body of the container and includes an annular channel that receives a portion of the lid. The annular channel is defined at its inner edge by a flexible finger having a locking tab that engages a corresponding locking notch formed on the lid to lock the lid onto the rim assembly. The container includes a specifically designed bottom having a projecting annular flange that can be received in an annular space formed along the top edge of the container between the lid and rim assembly when the lid is attached to the rim assembly. The container bottom also includes a projecting support leg that further supports the container when the containers are stacked on top of each other.

9 Claims, 5 Drawing Sheets

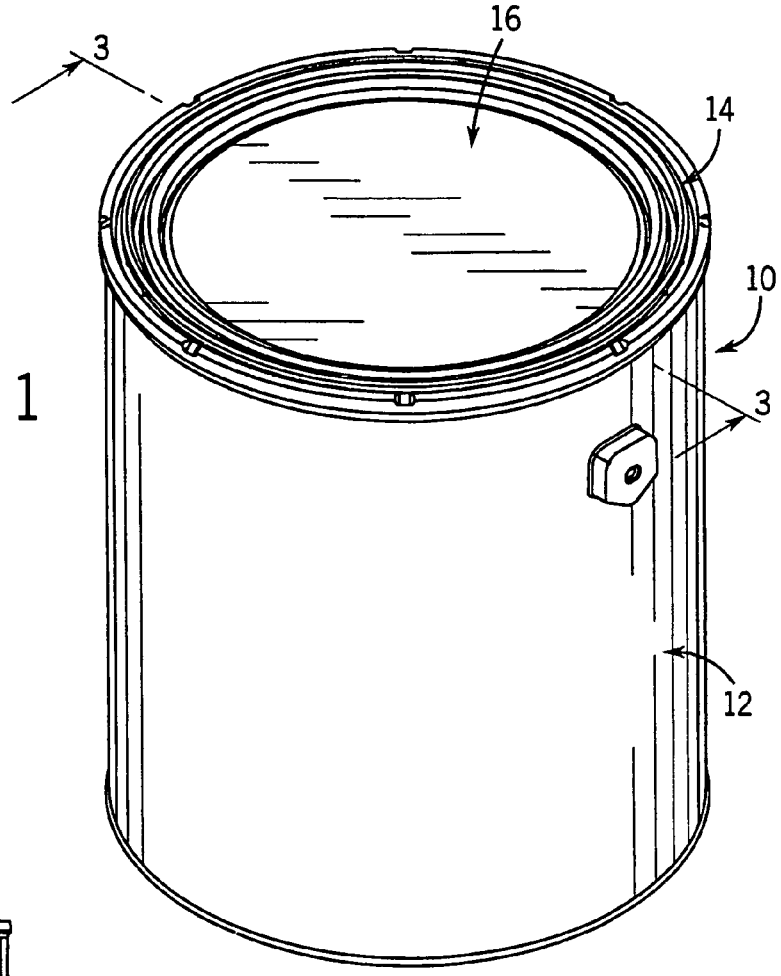
FIG. 1
FIG. 6
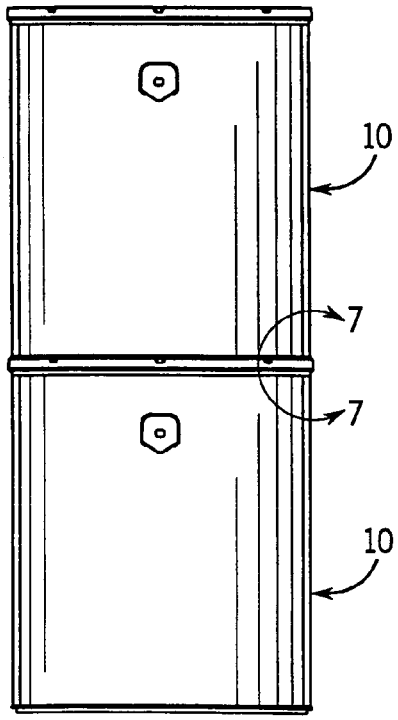
FIG. 7
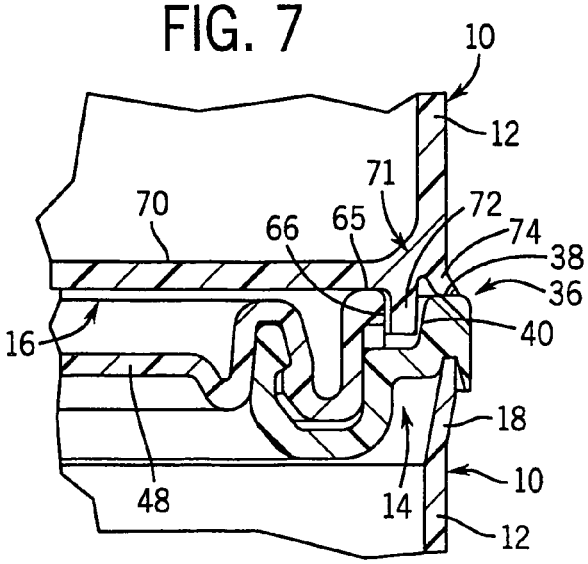

PLASTIC PAINT CAN

This application is based on and claims priority to provisional U.S. patent application Ser. No. 60/362,462, filed Mar. 7, 2002, and non-provisional U.S. patent application Ser. No. 10/174,890 filed Jun. 19, 2002 now abandoned the disclosure of which is incorporated herein by reference.

BACKGROUND OF THE INVENTION

The present invention generally relates to a cylindrical container having an open end sealed by a removable and resealable lid. More specifically, the present invention relates to a cylindrical container and lid assembly formed entirely of molded plastic.

SUMMARY OF THE INVENTION

The present invention is a cylindrical container, such as a paint can, that is formed by injection molded, substantially resilient plastic material and has an open end having a rim assembly that receives a removable and resealable plastic lid.

The rim assembly is molded and either adhesively attached or spun welded onto the main body of the container. The rim assembly includes a continuous, annular channel that is defined along its inner edge by a flexible finger having a locking tab. The annular channel receives a downward projection formed on the lid and the flexible finger of the rim assembly is received within a corresponding channel formed in the lid. The channel formed in the lid includes a locking notch that interacts with the locking tab formed on the flexible finger of the rim assembly to provide a secure point of attachment between the rim assembly and the lid.

The molded main body of the cylindrical container includes a specifically designed bottom edge that facilitates stacking of multiple containers. Specifically, the bottom edge of each container includes a projecting, annular flange that is received in a gap between a facing edge of the lid and an inner wall on the outer peripheral edge of the rim assembly when the lid is installed on the rim assembly. The bottom edge of the container further includes a projecting leg that rests upon a top surface on the outer peripheral edge of the rim assembly to further support the containers when stacked.

In accordance with the present invention, the entire container structure is formed from molded plastic components. The molded plastic components allow the container can to be used with various types of liquids and provides the required structural rigidity to perform the function of a typical, metal paint can.

In another aspect of the invention, a plastic container includes a rim assembly connected to the main body, the rim assembly including a first continuous, annular channel defined along an inner edge by a flexible finger having a locking tab, and defined along an outer edge by a sidewall joined to the lip. A lid is adapted to be connected to the rim assembly, the lid including a central planar section having an outer structure in the form of a second continuous annular channel formed with a locking notch on a solid, annular, downward projection having a shoulder outwardly projecting therefrom. The second annular channel receives the flexible finger on the rim assembly such that the locking tab on the rim assembly engages the locking notch, the first channel on the rim assembly receiving the downward projection on the lid, and the sidewall supporting the shoulder.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a perspective view of a cylindrical container having a rim assembly and lid of the present invention;

FIG. 6 is a side view illustrating the stacking of a pair of cylindrical containers;

FIG. 7 is a section view taken along line 7—7 of FIG. 6 showing the interaction between the bottom of a first cylindrical container and the lid and rim of a second cylindrical container that facilitates stacking of multiple containers;

DETAILED DESCRIPTION OF THE INVENTION

Figure 2:
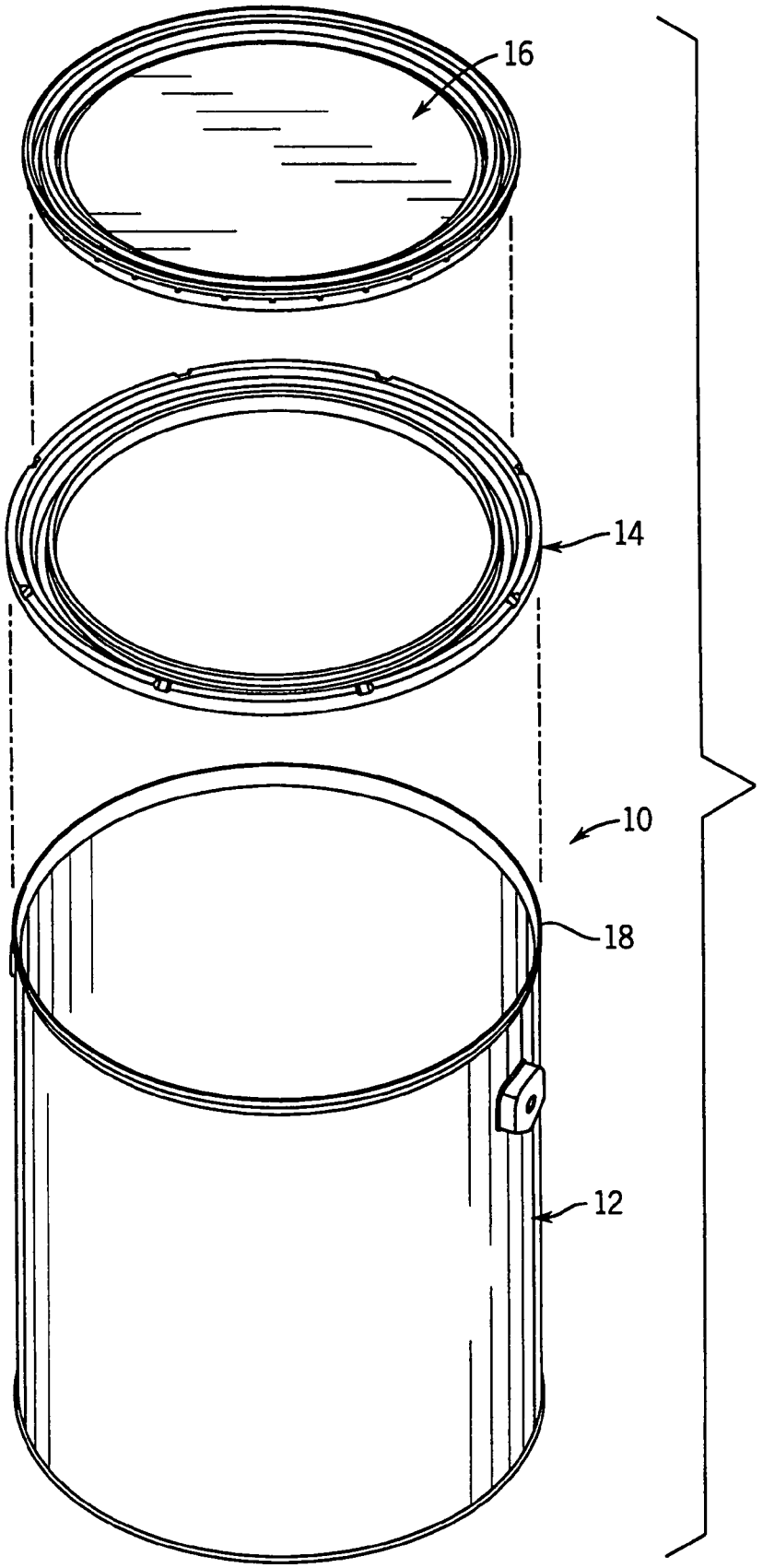
FIG. 2 is an exploded view illustrating the container, rim assembly and lid of the present invention.
Figure 3:
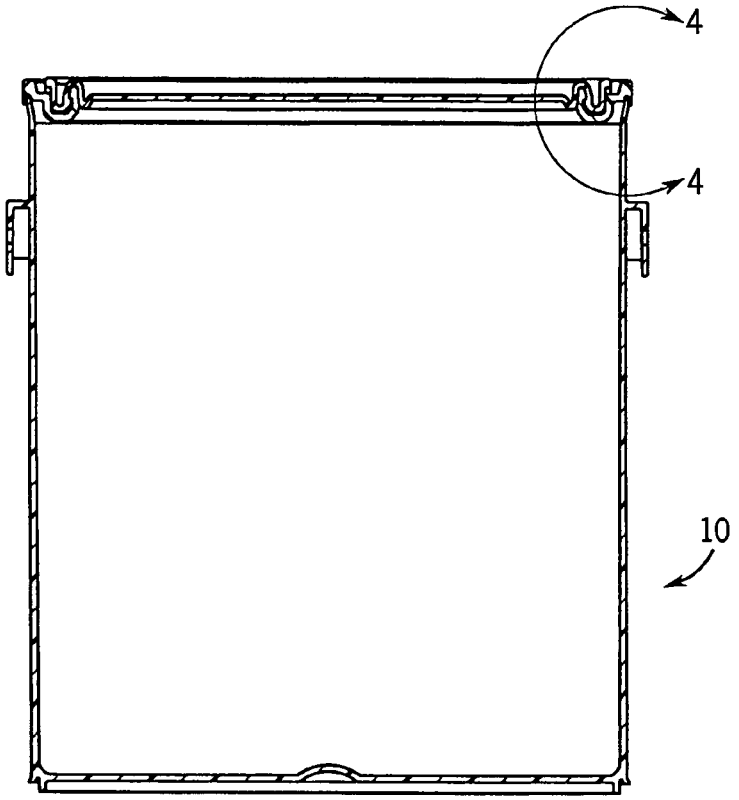
FIG. 3 is a section view taken along line 3—3 of FIG. 1.

As can be seen in FIG. 2, the container 10 includes a cylindrical main body 12, a circumferential rim assembly 14 and a lid 16 that combine to create the entire structure. The main body 12 defines an open interior and is formed from molded plastic and includes an upper lip 18 that is configured to receive the rim assembly 14. The rim assembly 14 and main body 12 are formed from separate molds of plastic and are either spun welded or adhesively bonded together to form a complete structure.

Figure 5:
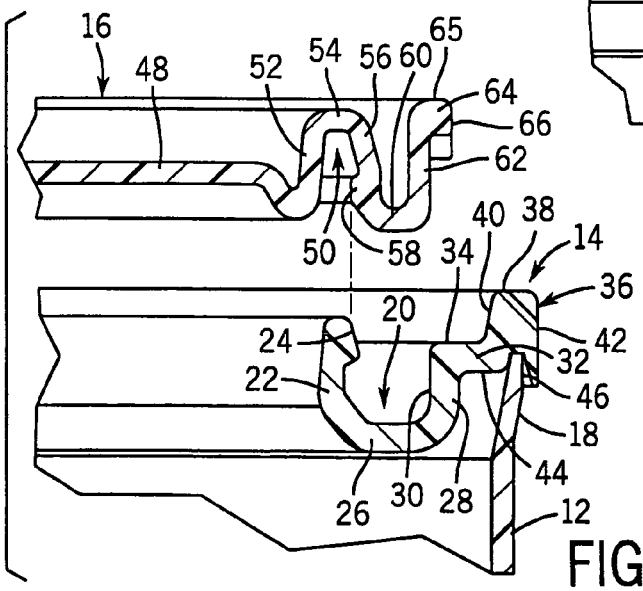
FIG. 5 is a view similar to FIG. 4 illustrating the removal of the lid from the rim.
Figure 8:
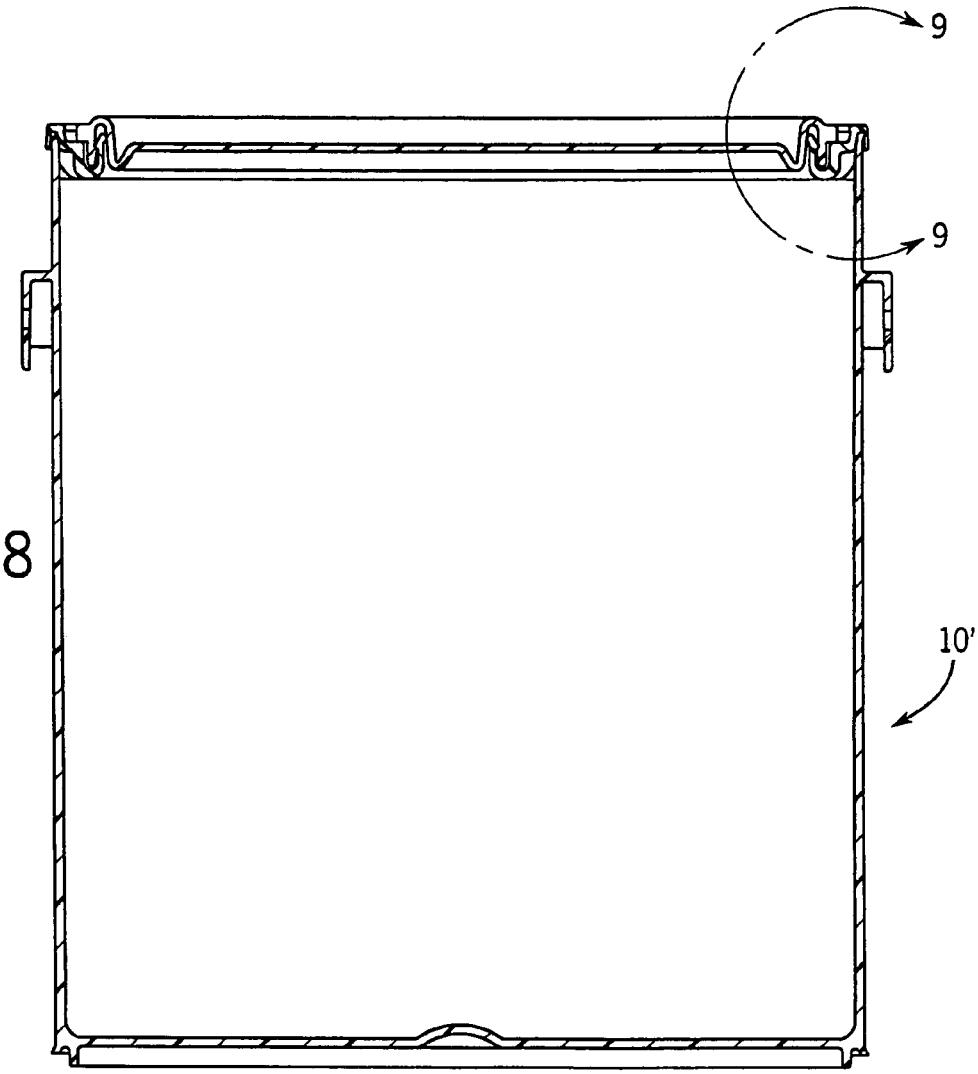
FIG. 8 is a view like FIG. 3 showing an alternative embodiment of the invention.

Referring now to FIG. 5, the rim assembly 14 includes an upwardly facing, continuous, annular open channel 20 that is formed along a radially inner-most edge by a flexible finger 22. The upper end of the flexible finger 22 is provided with an outwardly protruding locking tab 24. The lower end of the flexible finger 22 slopes outwardly and downwardly into a base 26 which defines a bottom of the channel 20. An outer edge of the channel 20 includes a sidewall 28 which rises upwardly from the base 26 opposite the flexible finger 22 and defines an inner bearing surface 30. A generally horizontally extending connector 32 has a base surface 34 and joins the upper end of the sidewall 28 with an outer peripheral edge 36 which defines the radially outermost structure of the rim assembly 14. The outer peripheral edge 36 has a top surface 38, an inner wall 40, an outer wall 42 and a bottom surface 44 formed with an upwardly extending groove 46. The groove 46 receives the upper lip 18 on the main body 12. Spin welding or adhesively attaching the aforedescribed rim assembly 14 with the main body 12 results in a complete structure which is adapted to receive the structure of the lid 16.

The lid 16 includes a central planar section 48 having outer edge structure in the form of a downwardly facing, continuous, annular channel 50. The channel 50 has a generally vertical inner wall 52 connecting with a roof portion 54 that slopes outwardly and downwardly along an outer wall 56 having an inwardly extending locking notch 58. The outer wall 56 merges into a curved base 60 which joins with an upwardly extending wall 62 terminating in an outer annular shoulder 64 having an upper surface 65 and a facing edge 66. The base 60 and the upwardly extending wall 62 form a downward projection which is designed to be received in the channel 20 of the rim assembly 14.

Figure 4:
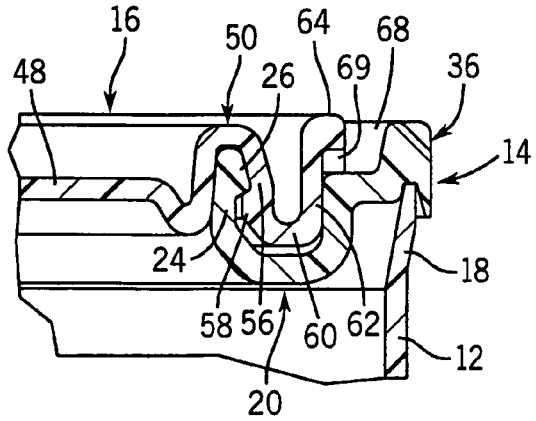
FIG. 4 is a magnified section view taken along line 4—4 of FIG. 3 illustrating the snap-fit interaction between the lid and rim of the present invention.

As can be seen from FIG. 4, when the lid 16 is pushed downwardly onto the rim assembly 14, the finger 22 including the locking tab 24 on the rim assembly 14 is received within the channel 50 on the lid 16. As the finger 22 enters the channel 50, the locking tab 24 engages the locking notch 58 on the lid 16 in a snap fit to securely retain the lid 16 on the rim assembly 14. At the same time, the outer wall 58, the base 60 and the upwardly extending wall 62 on the lid 16 are received in the upwardly facing channel 20 of the rim assembly 14 with the outer wall 58 engaged against the finger 22, and the upwardly extending wall 62 engaged against the bearing surface 30 of the sidewall 28. With this engagement, the outer annular shoulder 64 on the lid 16 is spaced from the base surface 34 of the rim assembly 14 as well as from the inner wall 40. The shoulder 64 allows a prying tool, such as a screwdriver, to be introduced via a spacing 68 and inserted into a gap 69 between the shoulder 64 and the surface 34 to release the lid 16 from the rim assembly 14.

Referring now to FIG. 6, in accordance with the present invention, a pair of containers 10 can be stacked in a manner shown. Specifically, each of the containers 10 is designed such that a planar bottom wall 70 has a bottom edge 71 which includes a continuous, protruding flange 72, as shown in FIG. 7. The flange 72 is sized to be positioned between the facing edge 66 of the lid 16 and the inner wall 40 formed on the outer peripheral edge 36 of the rim assembly 14. In addition to the flange 72, the bottom edge 71 of each container 10 includes an outwardly extending support leg 74 that is supported on the top surface 38 formed around the outer peripheral edge 36 of the rim assembly 14. When the upper can 10 is stacked on the lower can 10, the bottom wall 70 of the upper can is supported on the upper surface 65 of the outer annular shoulder 64 of the lid 16, and the leg 74 is supported on the top surface 38 of the outer peripheral surface 36 of the rim assembly 14. The flange 72 restricts the radial movement of the upper can 10 relative to the lower can 10. The combination of the outer annular shoulder 64, the flange 72 and the support leg 74, as illustrated, allows the paint cans 10 to be securely stacked one on top of each other, as illustrated in FIG. 6.

In accordance with the present invention, all of the components of the paint can, including the main body 12, the rim assembly 14 and the lid 16, are formed from molded plastic. The molded plastic used to form the container 10 prevents corrosion as compared to a typical metal paint can. Further, the use of a separate main body 12 and rim assembly 14 allows for molding of the components in a generally known manner.

FIGS. 8–11 show an alternative embodiment of the invention. In this version, the rim assembly 14' includes a more U-shaped annular channel 20' than channel 20 formed in part by a thinner walled flexible finger 22' having locking tab 24'. Locking tab 24' has an outer, lower periphery 25 which snap fits into structure on the cooperating lid 16', and an inner, upper periphery 27 which extends beyond the substantially vertical plane of the innermost surface of the finger 22'. Top surface 38' is slightly thinner than previously described surface 38.

Lid 16' includes central planar section 48', having outer edge structure in the form of a knee portion 49 and downwardly facing, annular channel 50' with inner wall 52' and roof portion 54'. Roof portion 54' slopes outwardly and downwardly along outer wall 56' which is formed with locking notch 58'. Wall 56' terminates in a solid, downwardly projecting, annular foot 75 which lies above the knee portion 49. Outer wall 56' is formed with a laterally and outwardly projecting shoulder 76 having an underside surface 77 and a facing edge 78.

The upper lip 18' on main body 12' is formed with an annular bead 79 which is snap fit and adhesively secured in groove 46' on the outer peripheral edge 36'.

Figure 9:
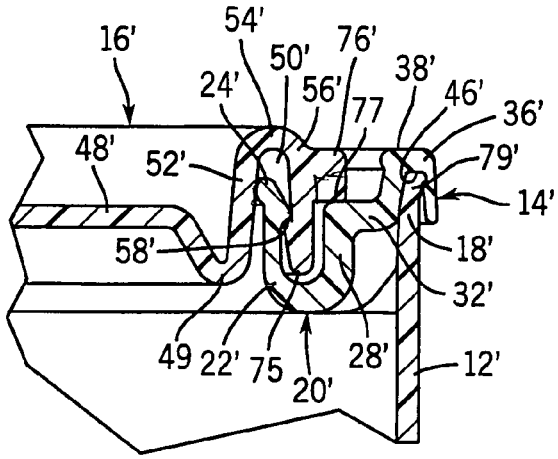
FIG. 9 is a magnified section view taken along line 9—9 of FIG. 8.
Figure 10:
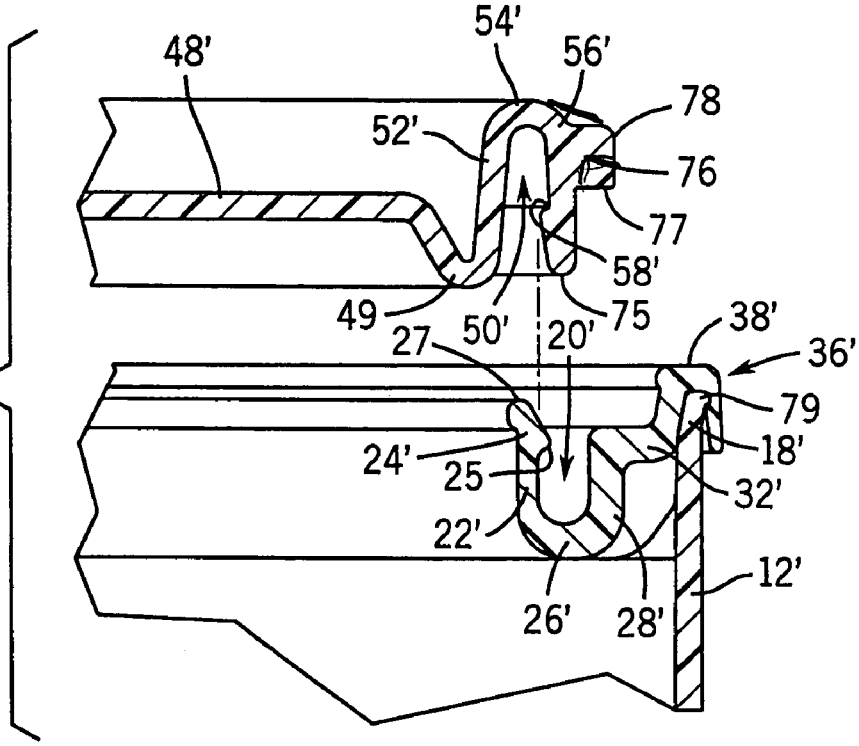
FIG. 10 is a view similar to FIG. 9 illustrating the removal of the lid from the rim.

As can be seen from FIG. 9, when the lid 16' is pushed downwardly onto rim assembly 14', the finger 22' including the locking tab 24' on rim assembly 14' is received within channel 50' on lid 16'. As the finger 22' enters the channel 50', the locking tab 24' engages the locking notch 58' on the lid 16' in a snap fit to securely retain the lid 16' on rim assembly 14'. At the same time, the periphery 27 on the finger 22' frictionally engages an inner surface of inner wall 52' to create an interference fit that prevents leakage of liquid. Also, it can be seen that the foot 75 extends into upwardly facing channel 20'. With this engagement, the underside 77 of shoulder 76 rests upon a top surface of connector 32'. Although not shown in the second embodiment of FIGS. 9–11, the projecting shoulder 76 includes a series of spaced gaps similar to the gap 69 of FIG. 4 that allow a prying tool, such as a screwdriver, to be forced between the underside 77 and the top surface of the connector 32' to release the lid 16' from the rim assembly 14'.

Figure 11:
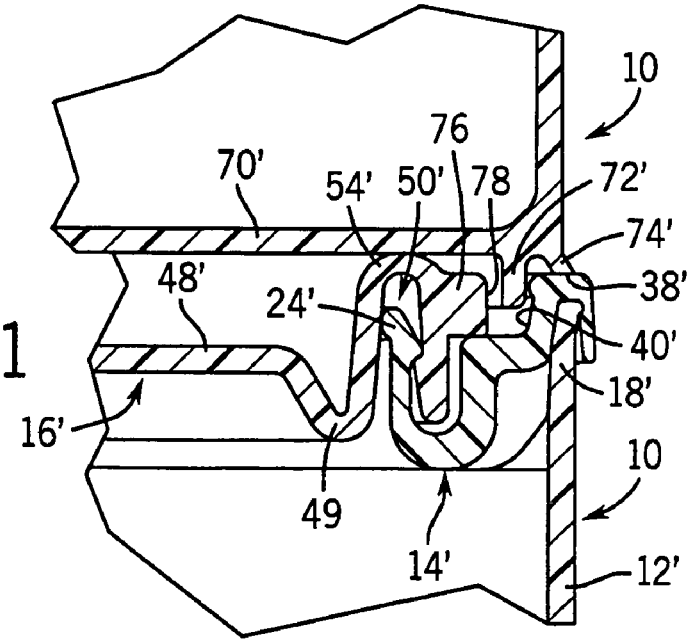
FIG. 11 is a section view like FIG. 7 for the alternative embodiment of FIG. 8.

Referring to FIG. 11, a pair of containers 10 can be stacked in the manner shown. Flange 72' on the upper container 10 is sized to be positioned between the facing edge 78 on lid 16' and the inner wall 40' on the edge 36' of rim assembly 14'. In addition, the bottom wall 70' of the upper container 10 rests upon the roof portion 54' of lid 16', and the leg 74' is supported on the top surface 38' of rim assembly 14'. Flange 72' restricts the radial movement of upper can 10 relative to lower can 10. The combination of roof portion 54' flange 72' and support leg 74' allows the paint cans 10 to be securely stacked one on top of the other.

Various alternatives and embodiments are contemplated as being within the scope of the following claims particularly pointing out and distinctly claiming the subject matter regarded as the invention.

We claim:

1. A plastic container comprising:

a generally cylindrical main body having a closed end defined by a bottom wall, and an open end defined by a circumferential lip at an upper end thereof;

a rim assembly connected to the main body, the rim assembly including a continuous, annular channel defined along an outer edge by a channel sidewall and along an inner edge by a flexible finger having a locking tab including an inner peripheral surface and an outer peripheral surface to define a locking tab width, the channel sidewall being connected to an outer peripheral edge of the rim assembly by a generally horizontal connector portion, wherein the channel sidewall is spaced radially inward from the main body such that the channel sidewall does not contact the main body, the outer peripheral edge including a groove for receiving the lip of the main body; and a lid adapted to be connected to the rim assembly, the lid including a second continuous annular channel having a channel width less than the locking tab width, the second annular channel having a downward projection received in the first channel, the downward projection having an outer annular shoulder supported on the horizontal connector portion of the rim assembly when the downward projection is engaged in the first channel, wherein when the second annular channel receives the flexible finger, the locking tab on the rim assembly flexes such that the outer peripheral surface of the locking tab engages a locking notch and the inner peripheral surface engages an inner wall defining the second annular channel to form a liquid tight interference therebetween, wherein the bottom wall on the main body including structure for stacking containers one on top of the other, the bottom wall having an annular flange adapted to be received between an outer annular shoulder and an outer peripheral edge an outer, of another container when stacked thereon, the bottom wall further having a support leg which is adapted to rest upon the top surface of an outer peripheral edge of the container to provide support for the bottom wall.

2. The plastic container of claim 1, wherein the rim assembly is snap fit and adhesively secured to the main body.

3. The plastic container of claim 1, wherein the first channel is upwardly facing.

4. The plastic container of claim 1, wherein the second channel is downwardly facing.

5. The plastic container of claim 1, wherein the locking tab on the rim assembly engages the locking notch on the lid in a snap fit.

6. The plastic container of claim 1, wherein the second channel includes an inner wall, a roof portion and an outer wall having the locking notch formed on an inner surface thereof.

7. The plastic container of claim 1, wherein the annular flange and the support leg are formed on a bottom edge of the bottom wall.

8. The plastic container of claim 1, wherein the bottom wall of a stacked container is further supported on a curved roof portion of the lid positioned inwardly of the outer annular shoulder.

9. The plastic container of claim 1, wherein the support leg extends outwardly and downwardly from the main body.

* * * * *